US007771258B2

(12) United States Patent
Condie et al.

(10) Patent No.: US 7,771,258 B2
(45) Date of Patent: Aug. 10, 2010

(54) COIN DISPENSER

(75) Inventors: Parker B. Condie, Creve Coeur, MO (US); William P. Morgan, Clayton, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 360 days.

(21) Appl. No.: 11/760,310

(22) Filed: Jun. 8, 2007

(65) Prior Publication Data

US 2007/0287372 A1 Dec. 13, 2007

Related U.S. Application Data

(60) Provisional application No. 60/804,219, filed on Jun. 8, 2006.

(51) Int. Cl.
*G07D 1/00* (2006.01)
*G07F 11/00* (2006.01)
*G07F 11/44* (2006.01)

(52) U.S. Cl. ..... 453/57; 221/131

(58) Field of Classification Search ..... 453/1, 453/18, 19, 57, 63; 194/92, 124, 282, 286
See application file for complete search history.

(56) References Cited

U.S. PATENT DOCUMENTS 5,813,510 A * 9/1998 Rademacher ..... 194/206
6,776,703 B2 8/2004 Abe et al.
7,066,807 B2 6/2006 Abe et al.
7,429,213 B2 * 9/2008 Enomoto et al. ..... 453/57

OTHER PUBLICATIONS

PCT/US07/70720 Notification of Transmittal of the International Search Report and the Written Opinion of the Inernational Searching Authority, or the Declaration (2 pages).
International Search Report (2 pages).
Written Opinion of the International Searching Authority (2 pages).

* cited by examiner

*Primary Examiner*—Patrick Mackey
*Assistant Examiner*—Mark Beauchaine
(74) *Attorney, Agent, or Firm*—Polster, Lieder Woodruff & Lucchesi, LC

(57) ABSTRACT

A device for dispensing coins comprising a plurality of hoppers arranged adjacent a sloped coin ramp. The hoppers are located to eject coins from the hopper onto the coin ramp. At least one hopper is mounted on a hopper shim such that the hoppers are installed at a plurality of heights. The hoppers further arranged in at least two rows with the coin ramp disposed therebetween and at least one hopper including a hopper bin that is of extended height with respect to another hopper bin.

14 Claims, 2 Drawing Sheets

COIN DISPENSER

CROSS-REFERENCE TO RELATED APPLICATIONS

This application claims priority to U.S. Provisional Application Ser. No. 60/804,219, filed Jun. 8, 2006, entitled COIN DISPENSER which is incorporated herein by reference.

FIELD OF THE INVENTION

The present invention relates to coin dispensers. More specifically, the invention relates to a coin dispenser having a plurality of bulk-loaded coin bins.

BACKGROUND OF THE INVENTION

In the past, coin hoppers have been used for numerous applications. For example, coin dispensers are frequently used in vending machines and are necessary because vending machine sales are made without a human cashier to make change. Providing a coin dispenser eliminates the requirement that a person have exact change in order to make a purchase from the vending machine. Coin dispensers can comprise a plurality of stacked tubes with each tube having a different denomination of coin. A vending machine calculates the required change by determining the amount of money inserted by the customer and subtracting the product price. The vending machine can then activate payout from coin tubes containing known coin denominations.

More recently, department stores and grocery stores have moved toward replacing human cashiers with self-checkout kiosks where a customer can tally the cost for items the customer wishes to buy for himself. Typically, the customer does this by moving the Universal Product Code bar codes over a laser scanner, which reads the codes. The customer is then presented with several methods to pay for the items, including cash. Typically, the kiosk will accept both paper currency and coins as payment. However, because the customer may not have exact change to make the purchase, the kiosk must be able to pay out change in at least coins, or perhaps paper currency as well, to provide change to the customer. However, due to the large quantity of change that must be paid out compared to product vending machines and the greater number of customers typically served, prior art coin dispensers lack a sufficient quantity of stored coins and/or the payout speed required of this higher volume application.

As a result, there is a need in the art for a coin dispenser that can hold a greater quantity of coins for payout in multiple denominations and pay out the required change at a high rate. However, in such self-checkout kiosks only a limited amount of space is dedicated for use by a coin dispenser to accomplish this goal. Therefore, the coin dispenser is preferable small and fits within the allowable footprint.

DESCRIPTION OF THE PREFERRED EMBODIMENT

Figure 1:
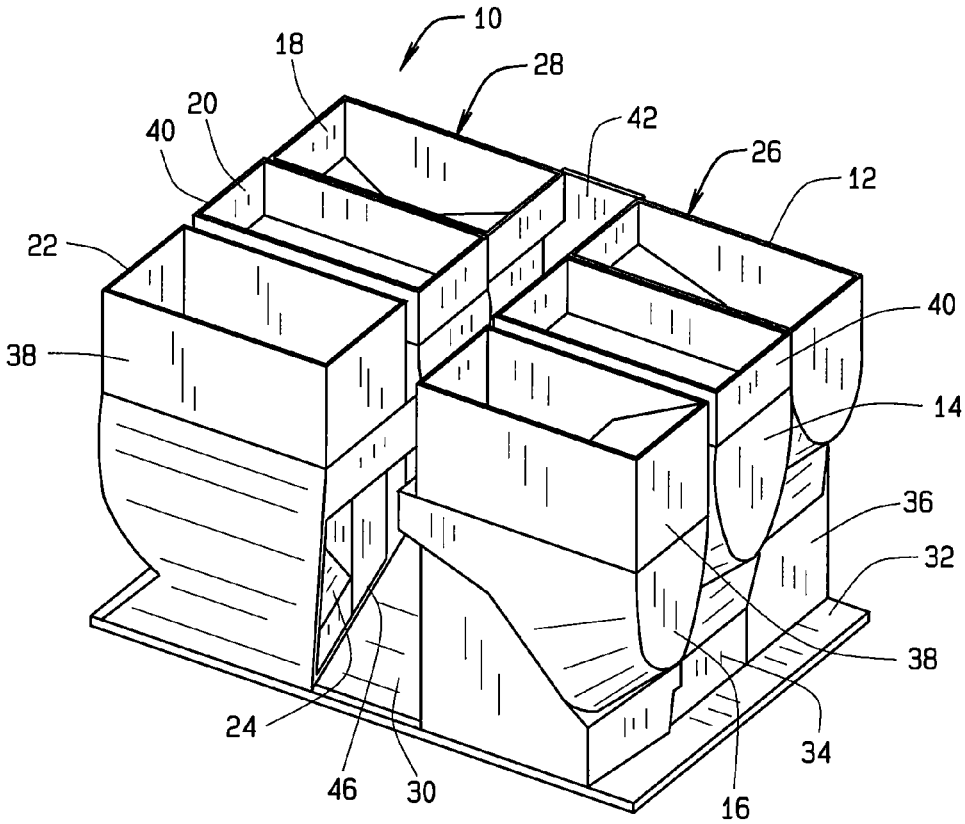
FIG. 1 is a six hopper coin dispenser according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The preferred embodiment of the present invention comprises a coin dispenser for a self-checkout kiosk that can payout coins more quickly than prior art coin dispensers and can hold a greater quantity of coins that are of multiple denominations in reserve. To that end and referring to FIG. 1, a first embodiment 10 of the invention is shown. The first embodiment 10 comprises six hoppers 12, 14, 16, 18, 20 and 22 for holding up to six different denominations of coins. The hoppers 12-22 comprise bulk-loaded coin hoppers each having their own confined payout mechanism according to known payout mechanisms for bulk-loaded coin hoppers. While bulk-loaded coin hoppers are the preferred hoppers, the term coin hopper as used herein also includes stacked or otherwise arranged coin hoppers as well. The hoppers 12-22 are aligned in a first row 26 of coin hoppers 12-16 and a second row 28 of coin hoppers 18-22. Disposed between the first row 26 and the second row 28 of coin hoppers 12-22 is a payout ramp 30 that slopes from a high point that is adjacent hoppers 12 and 18 to a mid point that is adjacent hoppers 14 and 20 and reaches a low point that is adjacent hoppers 16 and 22.

Preferably, the payout ramp 30 has a width of greater than twice the width of the widest coin to be paid out to prevent jamming of the coins as the coins are paid out simultaneously from each hopper 12-22, which is the preferred method of payout. Each hopper 12-22 comprises a coin outlet 24 which is located above the payout ramp 30 such that when each bulk-loaded coin hopper 12-22 pays out coins through its coin outlet 24 the coin is delivered to the top surface of the payout ramp 30.

Additionally, coins that are ejected through the coin outlet 24 generally strike the opposing coin hopper. As a result, a hardened coin ejection plate 46 is added to each hopper at a location opposite the opposite hopper's coin outlet. The coin ejection plate 46 is preferably made from a durable polymeric material.

As a result of the necessity for each hopper to deliver coins to the payout ramp 30, the coin hoppers 12 and 18 need to be located higher than the other coin hoppers 14-16 and 20-22 as a result of their location at the highest part of the payout ramp 30. Likewise, the coin hoppers 14 and 20 need not be located as high as the coin hoppers 12 and 18 but must be higher than the coin hoppers 16 and 22. To that end, the coin hoppers 12-22 are all mounted on a hopper base 32. However, only hoppers 16 and 22 are mounted directly to the hopper base 32. Hoppers 14 and 20 utilize a first hopper shim 34 placed between the hoppers 14 and 20. The first hopper shim 34 is of only such height as may be required to raise the coin hoppers 14 and 20 to a height sufficient to elevate the coin outlets 24 of the coin hoppers 14 and 20 so that they are not below the payout ramp 30. Likewise, a second hopper shim 36 must be placed between the hopper base 32 and the hoppers 12 and 18 to elevate said hoppers 12 and 18 such that their coin outlets 24 are not below the payout ramp 30.

Because the hoppers 16 and 22 are mounted lower than the hoppers 12 and 14 and hoppers 18 and 20, first hopper extensions 38 are attached to the hoppers 16 and 22 to bring the top of the hoppers 16 and 22 to the same height as hoppers 12 and 18. While hopper height extensions are the preferred embodiment of the present invention, one of ordinary skill in the art would recognize that rather than adding hopper extension, a hopper could be molded in single piece having an extended height and such a modification is within the scope of the present invention. This increases the capacity of the hoppers 16 and 22. In a similar manner, second hopper extensions 40 are attached to hoppers 14 and 20 to cause the top of the hoppers 14 and 20 to be of the same height as the top of the hoppers 12 and 18. As such, the capacity of hoppers 14 and 20 is increased above that of the unextended hoppers 12 and 18 but not as much as extended hoppers 16 and 22.

Finally, a coin blocking plate 42 is placed in a vertical orientation against the payout ramp 30 and against the hoppers 12 and 18 to prevent coins from falling off the top edge of the coin payout ramp 30 and not sliding down the payout ramp 30 as desired.

Figure 2:
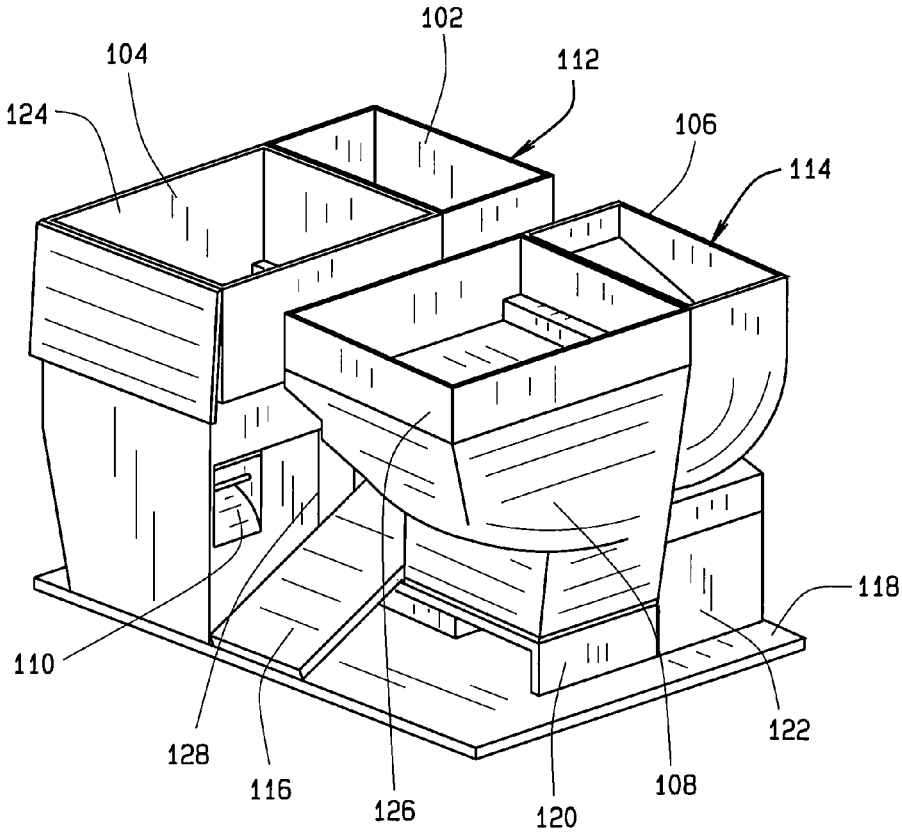
FIG. 2 is a four hopper coin dispenser according to an embodiment of the present invention.

Referring to FIG. 2, a second embodiment 100 of the invention is disclosed. The second embodiment 100 comprises four hoppers 102, 104, 106 and 108 arranged in a first row 112 and a second row 114. Each hopper 102-108 has a coin outlet 110 that will dispense coins onto a payout ramp 116 as with the first embodiment 10. The hopper 104 is mounted directly to a hopper base 118 and hopper 108 is mounted to a first hopper shim 120 placed upon the hopper base 118. The hoppers 104 and 108 comprise hoppers that cover twice the area of the hopper base 118 as the hoppers 12-22 or the hoppers 102 and 106. The hoppers 102 and 106 are mounted upon a second, taller hopper shim 122. The hopper 104 further comprises a first hopper extension 124, which increases the height of hopper 104 to the height of hopper 102 and increases the coin capacity of hopper 104. The hopper 108 further comprises a second hopper extension 126, which increases the height of hopper 108 to the height of hopper 106 and increases the coin capacity of hopper 108, as in the first embodiment. Additionally, coins that are ejected through the coin outlet 110 generally strike the opposing coin hopper. As a result, a hardened coin ejection plate 128 is added to each hopper at a location opposite the opposing hopper's coin outlet. In the second embodiment, the coin hoppers can be used to dispense, at most, four different denominations of coins simultaneously. It will be appreciated by one of ordinary skill in the art that any number of coin hoppers can be used without departing from the scope of the present invention The software controlling the operation of each coin hopper preferably monitors the level of each hopper and tries to maintain satisfactory levels of each coin denomination so that, for example, a hopper containing nickels is not depleted before a hopper containing quarters and vice versa. As a result a customer may receive five nickels, or two dimes and a nickel, for change rather than a quarter if the supply of quarters is depleting too rapidly. In the alternative, if a hopper containing dimes is depleting too rapidly, change will be given in denominations that avoids the usage of dimes.

The above examples show that the invention, as defined by the claims, has far ranging application and should not be limited merely to the embodiments shown and described in detail. Instead the invention should be limited only to the explicit words of the claims, and the claims should not be arbitrarily limited to embodiments shown in the specification. The scope of protection is only limited by the scope of the accompanying claims, and the Examiner should examine the claims on that basis.

We claim:

1. A device for dispensing coins comprising a plurality of hoppers arranged adjacent a sloped coin ramp, whereby the hoppers are located to eject coins from the hopper onto the coin ramp, at least one hopper being mounted on a hopper shim such that the hoppers are installed at a plurality of heights, the hoppers further arranged in at least two rows with the coin ramp disposed therebetween;

at least one hopper including a hopper bin that is of extended height with respect to another hopper bin; and wherein one of the plurality of hoppers disposed at a lower location along the sloped coin ramp comprises a hopper of extended height and one of the plurality of hoppers disposed at a higher location along the coin ramp is mounted upon the hopper shim.

2. The device of claim 1 wherein each hopper comprises a coin ejection plate opposite a coin outlet of the coin hopper of another row.

3. The device of claim 1 wherein the device further comprises coin blocking plate near the highest point of the coin ramp and between the rows of the hoppers.

4. The device of claim 1 wherein the coin ramp has a width greater than or equal to twice the width of the widest coin to be dispensed.

5. The device of claim 1 wherein the coin hoppers are bulk-loaded coin hoppers.

6. A device for dispensing coins comprising a plurality of hoppers arranged adjacent a sloped coin ramp, whereby the hoppers are located to eject coins from the hopper onto the coin ramp, at least one hopper being mounted on a hopper shim such that the hoppers are installed at a plurality of heights, the hoppers further arranged in at least two rows with the coin ramp disposed therebetween;

at least two hoppers having extended height hopper bins with respect to a third hopper bin; and wherein the at least two hoppers having extended height hopper bins with respect to a third hopper bin are not extended equally.

7. A device for dispensing coins comprising a plurality of hoppers arranged adjacent a sloped coin ramp, whereby the hoppers are located to eject coins from the hopper onto the coin ramp, at least one hopper being mounted on a hopper shim such that the hoppers are installed at a plurality of heights, the hoppers further arranged in at least two rows with the coin ramp disposed therebetween;

wherein one of the plurality of hoppers has a width which is greater than the width of another hopper.

8. A device of for dispensing coins comprising a plurality of hoppers arranged adjacent a sloped coin ramp, whereby the hoppers are located to eject coins from the hopper onto the sloped coin ramp, at least one hopper being mounted on a hopper shim such that the hoppers are installed at a plurality of heights, at least one hopper including a hopper bin that is of extended height with respect to another hopper bin;

wherein the hoppers are further arranged in at least two rows with the coin ramp disposed therebetween;

at least two hoppers having extended height hopper bins with respect to a third hopper bin; and wherein the at least two hoppers having extended height hopper bins with respect to a third hopper bin are not extended equally.

9. The device of claim 8 wherein the device further comprises coin blocking plate near the highest point of the coin ramp and between the rows of the hoppers.

10. The device of claim 8 wherein the coin ramp has width a greater than or equal to twice the width of the widest coin to be dispensed.

11. The device of claim 8 wherein the coin hoppers are bulk-loaded coin hoppers.

12. A device of for dispensing coins comprising a plurality of hoppers arranged adjacent a sloped coin ramp, whereby the hoppers are located to eject coins from the hopper onto the sloped coin ramp, at least one hopper being mounted on a hopper shim such that the hoppers are installed at a plurality of heights, at least one hopper including a hopper bin that is of extended height with respect to another hopper bin;

wherein the hoppers are further arranged in at least two rows with the coin ramp disposed therebetween;

at least two hoppers having extended height hopper bins with respect to a third hopper bin; and wherein one of the plurality of hoppers disposed at a lower location along the sloped coin ramp comprises a hopper of extended height and one of the plurality of hoppers disposed at a higher location along the coin ramp is mounted upon the hopper shim.

13. A device of for dispensing coins comprising a plurality of hoppers arranged adjacent a sloped coin ramp, whereby the hoppers are located to eject coins from the hopper onto the sloped coin ramp, at least one hopper being mounted on a hopper shim such that the hoppers are installed at a plurality of heights, at least one hopper including a hopper bin that is of extended height with respect to another hopper bin; and wherein each hopper comprises a coin ejection plate opposite a coin outlet of the coin hopper of another row.

14. A device of for dispensing coins comprising a plurality of hoppers arranged adjacent a sloped coin ramp, whereby the hoppers are located to eject coins from the hopper onto the sloped coin ramp, at least one hopper being mounted on a hopper shim such that the hoppers are installed at a plurality of heights, at least one hopper including a hopper bin that is of extended height with respect to another hopper bin; and wherein one of the plurality of hoppers has a width which is greater than the width of another hopper.

* * * * *